United States Patent [19]

Harris

[11] 4,291,783

[45] Sep. 29, 1981

[54] ACOUSTICAL PANEL FOR SUSPENDED CEILINGS

[75] Inventor: David A. Harris, Sylvania, Ohio

[73] Assignee: Owens-Corning Fiberglas Corporation, Toledo, Ohio

[21] Appl. No.: 141,871

[22] Filed: Apr. 21, 1980

Related U.S. Application Data

[63] Continuation of Ser. No. 973,309, Dec. 26, 1978, abandoned.

[51] Int. Cl.[3] ..... E04B 1/82

[52] U.S. Cl. ..... 181/295; 52/145

[58] Field of Search ..... 181/284, 286, 287, 290, 181/291, 295, 30; 52/144, 145, 765, 772

[56] References Cited

U.S. PATENT DOCUMENTS

| | | | |
|---|---|---|---|
| 2,218,965 | 10/1940 | Young et al. | 181/290 |
| 3,375,630 | 4/1968 | Dail | 52/144 |
| 3,452,496 | 7/1969 | Thompson | 181/292 |
| 3,867,240 | 2/1975 | Doerfling | 181/291 |
| 4,026,081 | 5/1977 | Delaney et al. | 52/145 |
| 4,040,213 | 9/1977 | Capaul | 181/291 |

*Primary Examiner*—Richard A. Wintercorn
*Assistant Examiner*—Benjamin R. Fuller
*Attorney, Agent, or Firm*—Ronald C. Hudgens; Philip R. Cloutier; Paul J. Rose

[57] ABSTRACT

The panel includes a fibrous glass board, a channel-shaped metal frame, and decorative fabric or plastic film adhered to the lower surface of the board and frame. The frame has an upper flange cooperable with an inverted T-bar of a suspended grid and a lower flange which extends halfway across the head of the inverted T-bar in the mounted position of the panel. Each pair of adjacent mounted panels covers the T-bar therebetween. The board is supported mainly by tabs on the frame. Because the bottom of the board is flush with the bottom of the frame, the frame is unnoticeable behind the decorative covering. The adherence of the decorative covering to the board and frame reduces potential sagging of the board and permits the panels to be made larger.

3 Claims, 4 Drawing Figures

ACOUSTICAL PANEL FOR SUSPENDED CEILINGS

This is a continuation of application Ser. No. 973,309, filed Dec. 26,1978 now abandoned.

This invention relates generally to suspended ceilings, and more particularly to an acoustical panel therefor.

An object of the invention is to provide an acoustical panel for use with suspended inverted T-bar grids, the panel being constructed so as to conceal the inverted T-bars when installed thereon.

Another object is to provide such a panel having a frame, a fibrous glass board, and a decorative covering, the board being supported mainly by taps on the frame projecting into the board above the lower surface thereof and the decorative covering being adhered to the board and the frame to prevent sagging of the board.

Other objects of the invention will become apparent when the following specification is considered along with the accompanying drawing in which.

Figure 1:
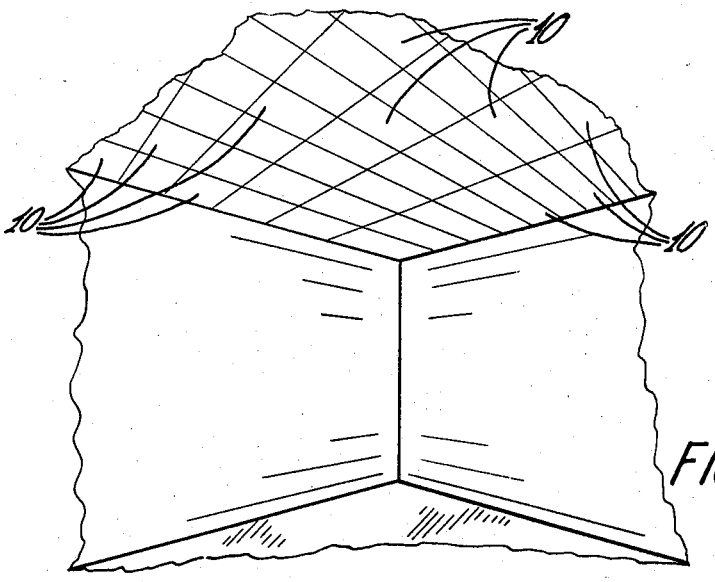
FIG. 1 is a fragmentary perspective view of a room having a suspended ceiling constructed of acoustical panels made in accordance with the invention.
Figure 3:
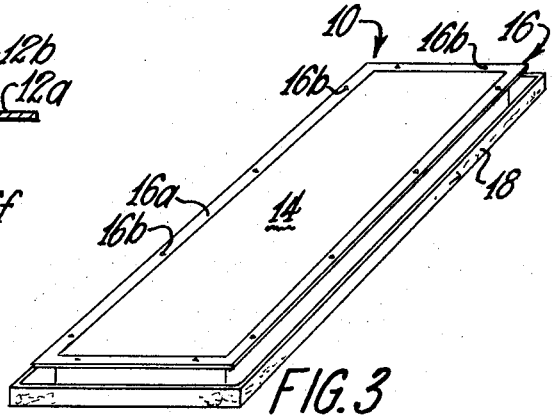
FIG. 3 is a perspective view of one of the acoustical panels of FIG. 1.

In the drawings, FIG. 1 shows a suspended ceiling including a plurality of acoustical panels 10 constructed in accordance with the invention. One of the panels 10 is shown more clearly in FIG. 3.

Figure 2:
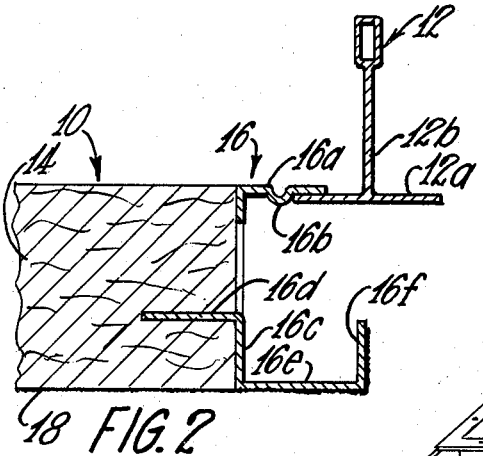
FIG. 2 is a fragmentary vertical sectional view through one of the inverted T-bars of the grid of the ceiling of FIG. 1 and an acoustical panel constructed in accordance with the invention mounted thereon.
Figure 4:
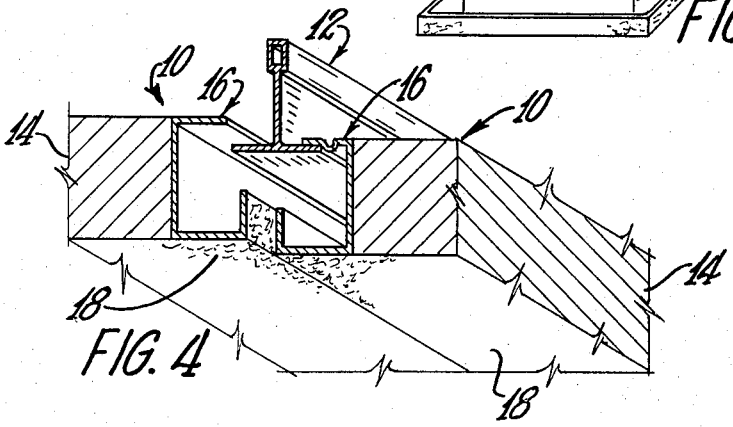
FIG. 4 is a fragmentary perspective sectional view of an iNVerted T-bar and two of the panels of FIG. 1 mounted thereon.

FIGS. 2 and 4 show a conventional inverted T-bar 12 forming part of a suspended ceiling grid for removably mounting panels 10. Each panel 10 includes a fibrous glass board 14, a frame 16, and a decorative covering 18 adhesively secured both to the board and to the frame.

The frame 16 is generally channel-shaped and includes an upper flange portion **16*a* provided with locating dimples 16*b*, a body portion 16*c* engaging the adjacent edge of the board 14 and having a plurality of spaced bent-out tabs 16*d* projecting into the board above the lower surface thereof, and a lower flange portion 16*e* having an upturned free end portion 16*f***.

When a panel 10 is suspended in the grid, by overlapping of the heads **12*a* of the inverted T-bars with the upper flange portions 16*a* of the frame, and properly located by the dimples 16*b*, the upturned free end portions 16*f* of the lower flange portions 16*e* will be substantially aligned with the trunk portions 12*b* of the inverted T-bars 12 on all four sides of the panel. Thus, each pair of adjacent panels 10 conceals the inverted T-bar 12 therebetween, as can be noted most clearly in FIG. 4**.

The lower surface of the board 14 is flush with the lower surface of the flange portion **16*e*, and the parting line between the board and the frame is unnoticeable behind the covering 18. The board is supported mainly by tabs 16*d* (only one of which is shown), and the covering 18, which may be fabric or plastic film, is adhesively secured both to the board 14 and to the portions 16*e* and 16*f*** of the frame to aid in preventing sagging of the board. These are advantages over the structure shown in U.S. Pat. NO. 4,026,081 wherein the covering is not adhered to the board and the frame and board are not flush at their bottoms.

Various modifications may be made in the structure shown and described without departing from the spirit and scope of the invention as set forth in the following claims.

I claim:

1. An acoustical ceiling panel suitable for mounting on a suspended grid of inverted T-bars and comprising a generally rectangular fibrous glass board, a generally channel-shaped metal frame surrounding the board, and a decorative covering adhesively secured to a lower surface of the board and to a lower surface of the frame, the frame on each edge of the board including a body portion engaging the adjacent edge of the board and having a plurality of tabs projecting into the board entirely above the lower surface thereof, the tabs being spaced from each other longitudinally of the body portion and having been sheared and bent out from the remainder of the body portion and forming the main support for the board, an outwardly extending upper flange portion adapted to overlap a head portion of one of the inverted T-bars of the grid, an outwardly extending lower flange portion having its lower surface flush with the lower surface of the board whereby backings for the decorative covering provided by the board and by the frame are coplanar, and an upturned free end portion on the lower flange portion, the upturned free end portion being substantially aligned with the trunk portion of the respective one of the inverted T-bars when the panel is properly positioned with respect thereto.

2. an acoustical ceiling panel as claimed in claim 1 including locating means on the upper flange portion of the frame on each edge of the board for properly positioning the panel with respect to inverted T-bars of the suspended grid.

3. An acoustical ceiling panel as claimed in claim 2 wherein the locating means comprises a plurality of dimples in the upper flange portion of the frame on each edge of the board.

* * * * *

UNITED STATES PATENT AND TRADEMARK OFFICE

CERTIFICATE OF CORRECTION

PATENT NO. : 4,291,783

DATED : September 29, 1981

INVENTOR(S) : David A. Harris

It is certified that error appears in the above–identified patent and that said Letters Patent are hereby corrected as shown below:

Column 1, line 16 should read:

the board being supported mainly by tabs on the frame

Signed and Sealed this

*Ninth* Day of *February 1982*

[SEAL]

*Attest:*

GERALD J. MOSSINGHOFF

*Attesting Officer*

*Commissioner of Patents and Trademarks*